United States Patent [19]

Twyford

[11] 4,203,016

[45] May 13, 1980

[54] ELECTRIC SWITCH UTILIZING COIL SPRING TORSION BIASING IN SWITCH OPERATION

[75] Inventor: Robert H. Twyford, Springfield, Va.

[73] Assignee: Mechanical Enterprises, Incorporated, Sterling, Va.

[21] Appl. No.: 958,829

[22] Filed: Nov. 8, 1978

[51] Int. Cl.[2] ..... H01H 3/12; H01H 1/06

[52] U.S. Cl. ..... 200/159 R; 200/276

[58] Field of Search ..... 200/159 R, 245, 250, 200/275, 276, 290, 67 C

[56] References Cited

U.S. PATENT DOCUMENTS

| | | | |
|---|---|---|---|
| 3,767,878 | 10/1973 | Sykora | 200/276 X |
| 3,860,776 | 1/1975 | Lockard | 200/276 |
| 3,920,943 | 11/1975 | Lapointe | 200/159 R |
| 3,949,181 | 4/1976 | Kempf | 200/159 R |

*Primary Examiner*—Steven M. Pollard

*Attorney, Agent, or Firm*—Schuyler, Birch, McKie & Beckett

[57] ABSTRACT

A miniaturized electric switch particularly suitable for electronic keyboard control applications includes at least one coil spring having a laterally extending coil spring end contact where spring compression biases the switch toward an unoperated condition and spring torsion urges the end contact relative to a second contact and a switch housing mounted cam engages the coil spring end contact incident operation of the switch between operated and unoperated conditions to urge the end contact relative to the second contact.

19 Claims, 7 Drawing Figures

12
4
16
14
10
32
18
40
38
5
5
42
36
52
52
54
36
50
50
6
6
46
44
44
36
34
62
48
20
48
22
26
22
26
60
30
28
24
4
30
60
28

ELECTRIC SWITCH UTILIZING COIL SPRING TORSION BIASING IN SWITCH OPERATION

This invention relates to manually operated push button switches for making or breaking electrical contact in an electrical circuit. More particularly, the invention is directed to electrical switches which are miniaturized and employed in keyboards for controlling electronic equipment involving low voltage and low current use.

Conventional switches that are operable manually are susceptible to contact bounce, making them unsuitable for direct employment in electronic data processing equipment. For example, as an input to a transistor switching circuit they are a problem without provision of filtering or buffering devices. For a switch to be suitable for operation in an electronic keyboard, such as used on typewriter style keyboards, it requires a combination of characteristics in order to meet not only the technical operating requirements for the electrical circuit control but also the characteristics demanded by an operator who may operate a keyboard continuously.

Many applications exist for keyboards wherein the keys or push buttons on the keyboard effect actuation of switches that are integrated into electronic circuits for carrying out a computer or data processing operation. The cost of such keyboards is indeed a significant factor considering the substantial number of remote terminals, input devices and other peripheral equipment used in computer and data processing applications. Demand for keyboards with keys or push buttons controlling miniaturized electric switches occurs in large volume in solid state adding machines and calculators comprising desk top models down to the small pocket size adding machine or calculator. Each requires a miniaturized switch and a key top or push button assembled into the keyboard arrangement.

Electrical switch constructions suitable for the above-mentioned variety of keyboards have been developed in a range from mechanical-electrical proposals through elaborate electronic switching concepts. With the large keyboard volume, critical cost factors in keyboard construction involves low initial investment, maintenance free operation and high operational reliability for the keyboard switches. Computer and related data processing industries require a keyboard switch which will give a circuit closing signal which is bounce free. A bounce free circuit closes to give a clear electric signal wherein a non-erratic rise from one voltage level to another occurs when the switch is closed by depression of the key or push button mounted to actuate the switch. Many keyboard switches require the use of additional components in the form of bounce gates or delay circuits so that the undesirable, unclean or fluttering closure of the electrical circuit is blanked out and prevented from interferring with proper operation of the solid state circuit control by electrical signal data. Such bounce gates and/or delay circuits obviously add to the cost of the keyboard and related equipment.

Metal-to-metal contact switches have been generally avoided in attempting to develope a bounce free switch. Unclean, fluttering or bouncing closure of the signal in the electric circuit is frequently the result of metal-to-metal contact switches. Accordingly, highly refined and elaborate electronic switch proposals have been suggested for keyboard utilization. Not only are they complex and quite expensive to achieve the desired clean coded electronic signal data, but also they may lack the flexibility to make up a keyboard capable of meeting the wide variety of computer and data handling applications.

This invention has as its principle object the provision of a miniaturized manually operable electric switch for generating electrically significant data through utilization of a multiple of such switches in computers, calculators, adding machines, etc., where keyboards are employed.

Referring again to the prior art, it has frequently been considered that wiping contacts in a switch, even one used in switchboard applications, are an advantage. It is believed that wiping contact action actually contributes to and prevents low bounce for the switch while the contacts are rubbing together. Additionally, contact wiping within the switch promotes contact wear, shortened switch life and roughing of the contacts which inherently introduces noise and erratic operation within the low voltage and low current circuit being controlled.

Accordingly, a further primary object of the instant invention is provision of a low cost reliable miniaturized switch wherein minimal relative movement of the switch contacts incident switch operation occurs to produce very low bounce switch closing characteristics.

A further object is to provide a low cost switch with ideal touch and feel incident switch operation wherein the switch contacts close intermediate the uppermost unoperated condition and bottom most position to give the most desired and operator accepted comfort in keyboard operation and a switch characterized by long life incorporating a minimum of required parts.

It is also an object to provide a miniaturized switch which ideally lends itself for keyboard operations where a single switch assembly body can be molded or otherwise formed to house the few parts of each miniaturized switch in individual cavities formed within the switch assembly body.

The present invention meets the above-mentioned objects, aims and purposes by being formed with a housing cavity which reciprocably mounts the switch actuating plunger. Coil spring means, preferably made up of two separate coil springs spaced parallel to one another are disposed within the cavity with the coil springs in compression urging the plunger outwardly of the cavity. One end of the coil spring means has a connector for connecting the switch into an electrical circuit to be controlled and the other end of the coil spring means has a laterally extending end providing one of the switch contacts. The second switch contact may be provided, and is in the preferred embodiment, by a second coil spring where the torsional forces of the coil spring means urge the laterally extending end first contact relative to the second contact in the switch. Stationary cam means carried by the housing act to urge the laterally extending end relative to the second contact to open and close the contacts incident actuation of the switch between operated and unoperated conditions.

A key top or push button may be appropriately used in connection with the switch acting through the switch actuating plunger to achieve switch operation. Although the switch may be configured in a normally closed switch configuration, the greater volume of keyboard control switches utilizes a configuration where the switch is normally electrically open.

DETAILED DESCRIPTION OF SWITCH INVENTION

Figure 1:
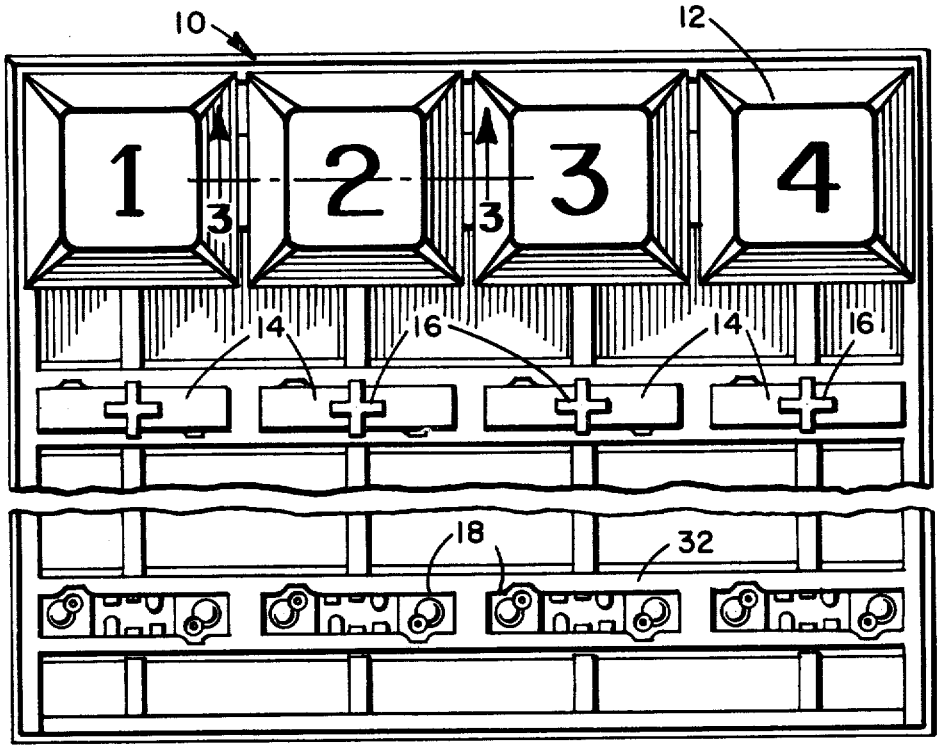
FIG. 1 is a plan view of a switch assembly body to accommodate multiple switches, four switches shown in place carrying key tops, four switches shown in their housing cavities within the switch assembly body without key tops and four housing cavities shown within the switch assembly body devoid of switch parts.
Figure 2:
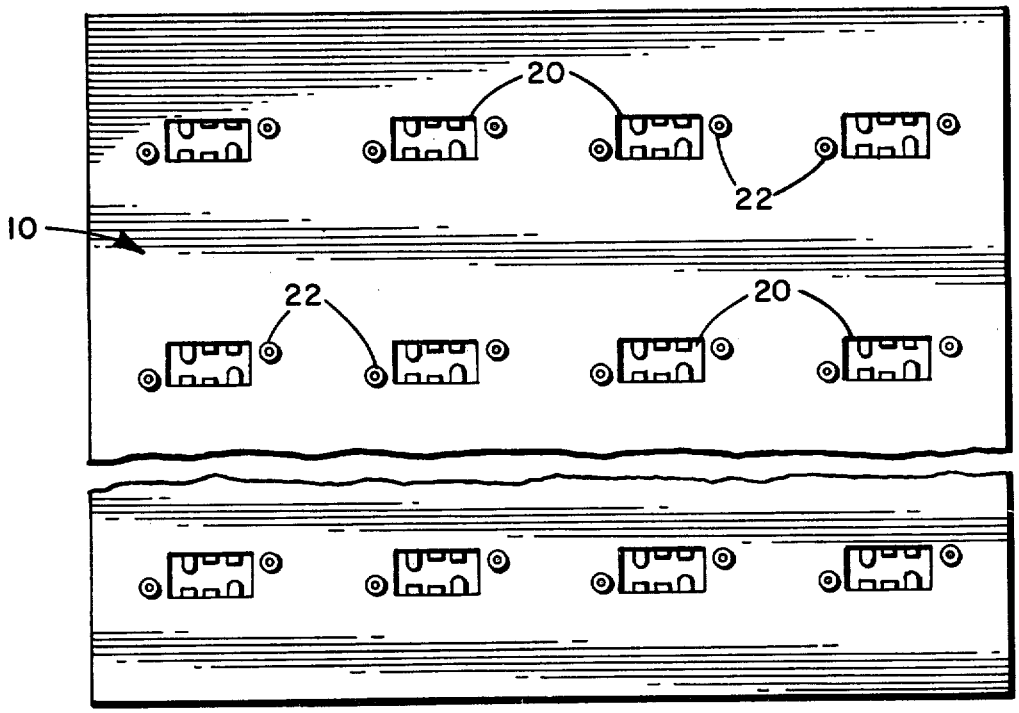
FIG. 2 is a bottom plan view showing the underside of the switch assembly body illustrated in FIG. 1.

Initially, reference may be made to FIGS. 1 and 2 on the drawings. FIG. 1 shows in top plan a switch assembly body 10. FIG. 2 shows the body 10 in bottom plan. The conformation of the switch assembly body 10, as illustrated in FIGS. 1 and 2, is shown in a form to accommodate three rows of four switches in each row. In the top row of four switches the complete switch with key tops 12 mounted on the upper end of each switch plunger is illustrated. As is characteristic, each key top will display indicia indicating the particular electrical circuit controlled by actuation of the switch disposed beneath the key top. Arbitrarily, in illustrating the row of key tops on FIG. 1 of the drawings, the indicia are the numbers 1, 2, 3 and 4 on the four key tops, respectively. The second row of switches as illustrated mounted in the body 10, displaying the switch parts in place. The switch actuating plunger 14 for each of the four switches in this row appears at the top of the cavity in which the switches are mounted in body 10. The upper end of each plunger 14 carries a cross mounting 16 onto which the key top for each switch, such as 12 shown in the upper row on FIG. 1, is pressed. It will be understood that the key top 12 is formed to have a press-fit with the cross mounting 16 on top of each plunger 14.

The bottom row of the switch assembly body 10 shows the series of cavities 18 which are generally rectangular in cross section and are aligned end to end within the body 10. Each of the cavities 18, as shown in the lower row of cavities on FIG. 1, is internally formed to receive and accommodate the switch parts in the manner as will be described hereinafter. It will be understood that the body 10 with its plurality of cavities may most conveniently be injection molded from a suitable plastic material. By such technique, not only may the cavities be appropriately positioned to accommodate the desired size for the key top 12 and accommodate the switch parts but also the cavities 18 may be most easily molded to have the desired form to handle the switch parts that are assembled into each cavity to form each switch. However, it is to be recognized that the switch assembly body 10 may be formed by other techniques within the contemplation of this invention. Also, a single cavity body may be molded or otherwise formed with one housing cavity where mounting of a single switch or separate switches in different arrangements to meet the needs of the user are in order.

Finally, although in FIG. 1, a configuration for the switch assembly body 10 shows only three rows of four switches in series, it will be recognized that the body 10 may be formed to provide as many switch cavities as desired with these cavities being located relative to each other in the configuration desired by the key board user. One convenient configuration for a number of switches to be mounted in a switch assembly body utilizes a keyboard configuration of four rows of four switches for a total of sixteen switches assembled in a single body configuration for immediate use in a keyboard application of limited size dimensions. Another popular configuration for the arrangement of cavities molded or otherwise formed into a single switch assembly body 10 would be in the more or less conventional form of keyboard such as a typewriter style keyboard. Again, more or less cavities can be molded into a single switch assembly body 10 to meet the desires of the ultimate user. Individual switch parts will be assembled in each cavity within the body depending upon the number of cavities formed in the particular switch assembly body for an individual user's demands.

The underside of the switch assembly body 10, as shown in FIG. 2, has an essentially flat surface. In the embodiment as illustrated, the bottom wall of the body 10 has an opening 20 leading upwardly into the cavity 18 for each switch. Also, the bottom wall has formed on its underside, relative to each opening 20, a pair of downwardly projecting bosses 22. A pair of such bosses is properly located relative to each opening 20 so that each switch assembled into body 10 will have a pair of spaced bosses through which the connectors from each switch will pass. The function of the bosses 22 in mounting a switch assembly body is more effectively shown on the sectional view of FIG. 3. The location of the cavities 18, openings 20 and bosses 22 in the bottom of the switch assembly body 10 is particularly organized such that the entire switch assembly body with all of its completed switches may be simply and effectively secured to a printed circuit board 24. In so mounting the switch assembly body 10 or individual switch housing where separate switches are desired, the bosses 22 engage within appropriately spaced recesses 26 in the printed circuit board 24. The connectors leading from the individual switches pass downwardly through the bosses 22 and through the printed circuit board 24. The underside of the printed circuit board 24 will appropriately have formed thereon the desired circuitry 28 which is to be controlled by the switches mounted on the board within switch assembly body 10. The circuitry is illustrated on FIGS. 3 and 4. Once the switch connectors have been inserted through the printed circuit board and the circuitry 28 a solder connection 30 may be made to connect each of the switches into the circuitry in its proper location as is conventional in printed circuit board techniques.

Each cavity 18 is to house one switch. In accordance with the instant invention each cavity 18 is formed in a housing 32 that constitutes a part of switch assembly body 10 where a multiple assembly of switches is to be provided. Of course, as previously mentioned, an individual housing 32 for a single switch providing a single cavity 18 may be utilized where single or separately widely spaced switches are to be mounted in the particular application desired.

Figure 5:
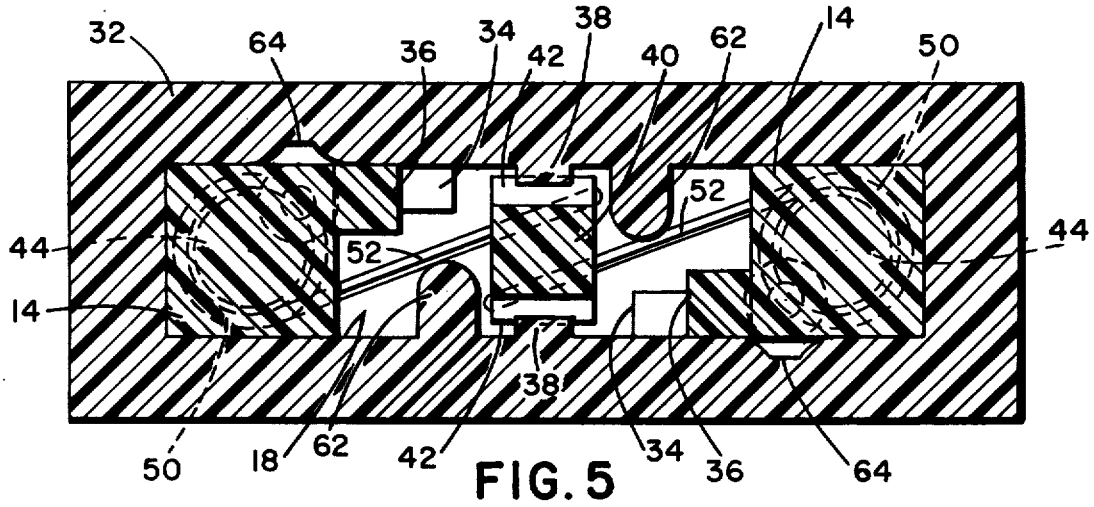
FIG. 5 is a sectional view taken on line 5—5 of FIG. 3.
Figure 6:
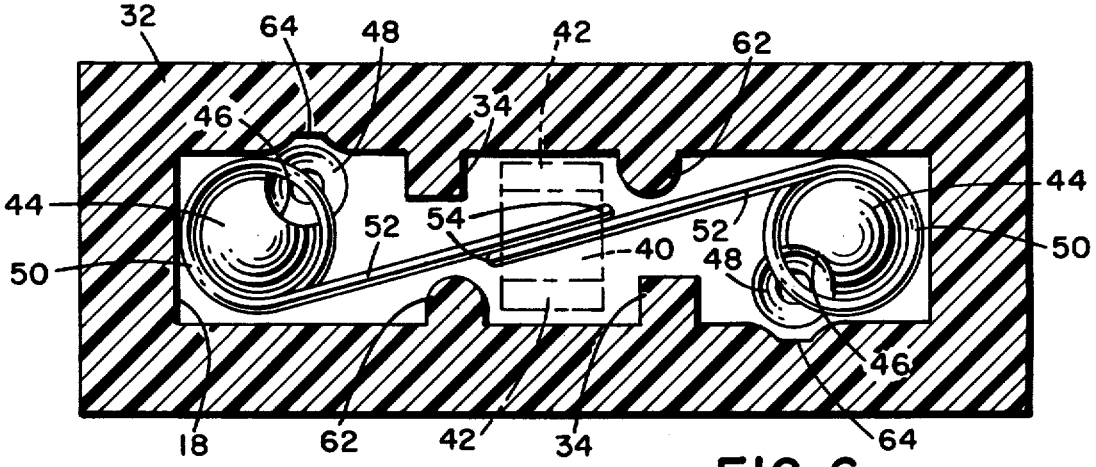
FIG. 6 is a sectional view taken on line 6—6 of FIG. 3.
Figure 7:
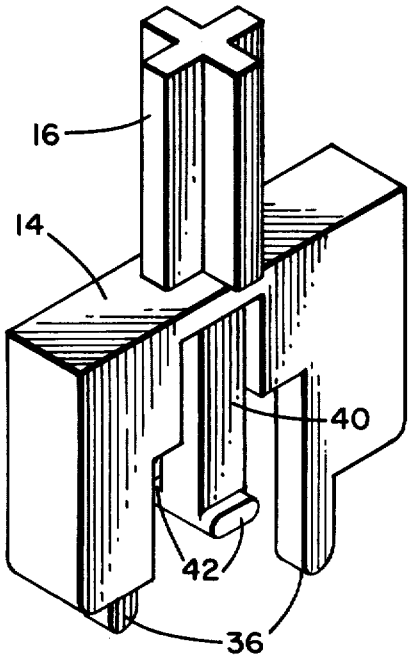
FIG. 7 is a perspective view of the switch actuating plunger.

The switch actuating plunger 14 is reciprocally mounted in cavity 18 within housing 32. To guide reciprocating movement of plunger 14 within cavity 18, the opposite sides of the cavity 18 are provided with inwardly extending ribs 34 as shown in the sectional views of FIGS. 5 and 6. To complete the guiding function, the plunger 14 is provided with guides 36, one such guide being located on each of the opposed faces of the plunger 14 as shown in FIGS. 5 and 7. Thus, the outwardly facing surfaces of ribs 34 within the cavity 18, guide the plunger 14 with the inwardly facing surfaces of guides 36 on the plunger sliding along the ribs 34.

Once the parts have been assembled within the cavity 18 to complete an operable switch, it is desired that the plunger be retained against being expelled outwardly of cavity 18, at least no further than to return the switch to its unoperated condition.

Figure 4:
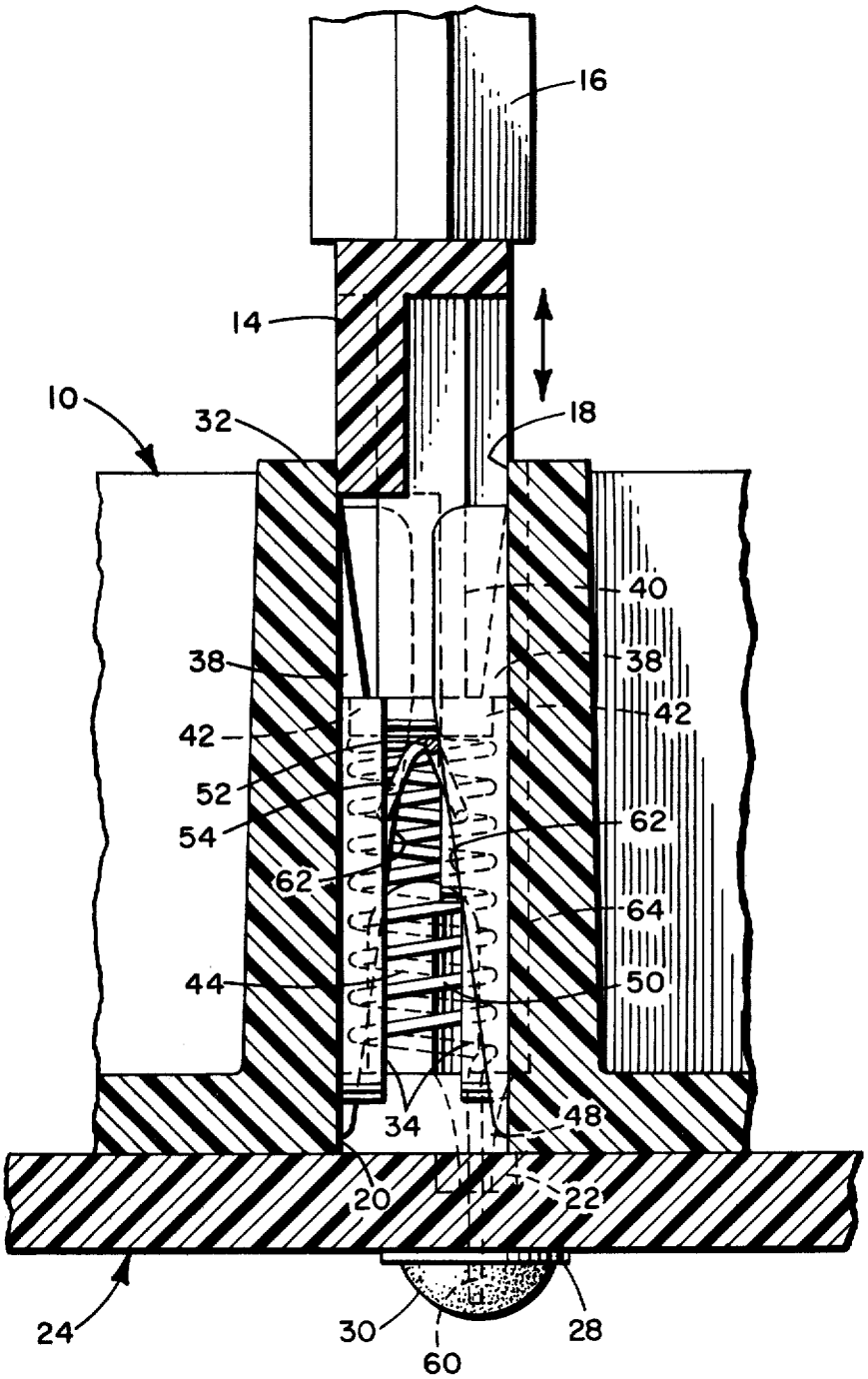
FIG. 4 is a sectional view taken on line 4—4 of FIG. 3.

Plunger 14 may be appropriately molded from a plastic material to give it sufficient yieldability to be snapped into retained position within cavity 18 of housing 32. To retain plunger 14 in the housing cavity 18, once it is snapped into place, the interior opposite walls of cavity 18 are provided with detents 38. As shown in FIG. 4, detents 38 are inclined downwardly and inwardly into the space within the cavity 18. The plunger 14 has a central stem 40 carrying at its lower end a pair of laterally projecting catches 42. When the plunger 14 is pressed down firmly into the cavity 18, the material of the catches 42 and/or the material of the housing 32 on which the catches 38 are mounted, yield such that the catches 42 are pressed down beneath the lower ends of the detents 38. Their interengagement thereafter retains the plunger 14 against movement out of the cavity 18 under the biasing action of the coil springs described hereinafter in connection with the operating mechanism of each switch of this invention. The extent of interengagement of the detents 38 with the catches 42 may be varied as desired. Basically, it is desirable to have sufficient interengagement to prevent removal of the plunger 14 from cavity 18 once the switch has been properly and effectively assembled.

Figure 3:
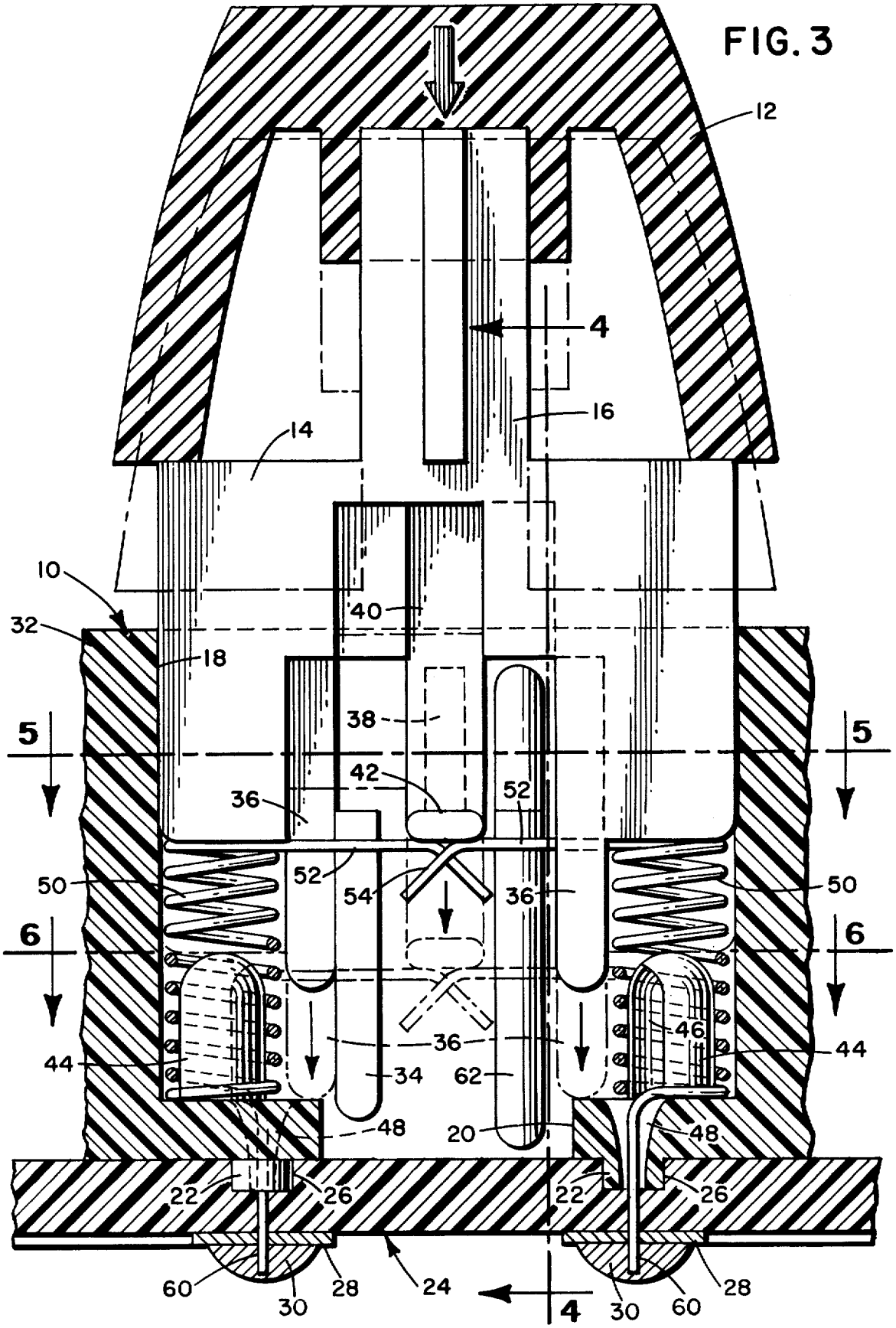
FIG. 3 is a sectional view of one of the switches of this invention taken on line 3—3 of FIG. 1.

The bottom wall of cavity 18 within housing 32 carries a pair of spaced parallel pins 44. These pins are located generally above the bores leading to the above described bosses 22. Each pin 44 is appropriately grooved at 46 leading down to the bore 48. The bore 48 is flared from an enlarged opening on the inner side of cavity 18 down to a smaller diameter where it passes through boss 22. Each pin 44 supports a coil spring 50 which performs two functions. First, in compression, the coil springs 50 serve to bias the switch actuating plunger 14 upwardly to its uppermost position within cavity 18 for the switch to be in its unoperated condition. Second, each coil spring 50 has a laterally extending end 52 projecting tangentially off of the uppermost coil of spring 50 leading toward the center portion of cavity 18. Both laterally extending ends 52 of coil springs 50 are thus disposed beneath the end of stem 40 carrying catches 42. This is best shown in FIG. 3. Each laterally extending end 52 is angled downwardly, as shown in FIG. 3, so that the two ends of these laterally extending portions of coil springs 50 provide contacts 54, crossing at generally right angles to each other when they move into engagement. The torsional forces of the two springs 50 are employed in bringing the contacts 54 of crossed ends 52 into electrical contact with each other.

Preferably, the coil springs 50 are constructed of cylindrical cross section wire. Particularly this becomes desirable with reference to the contacts 54 on ends 52. With a cylindrical cross-section at the point of engagement of contacts 54 an essentially point-to-point contact between contacts 54 is achieved. Then, even the slight torsional forces provided by springs 50 in bringing the ends together will be concentrated at the contact point to better assure electrical circuit closing with minimum bounce incident switch operation. Switch contact closing occurs part-way through the distance of movement of the switch from unoperated to operated condition. This provides the switch with over-travel capability or switch plunger movement beyond the contact closure point. Thus, in a commercial embodiment, about halfway through the downward depression of the switch, or at approximately 0.15 inches of movement, contacts 54 close. Over-travel permits the switch to close without its having to bottom out by full switch key depression, a characteristic found desirable by keyboard operators.

To hold the springs 50 in proper location, the lower coil of each spring has its end formed into a connector 60. This end is formed to extend generally axially of the coil spring axis. It passes through the flared bore 48 in the bottom of the housing cavity 18 for suitable connection into the electrical circuit to be controlled, as by means of the connection through printed circuit board 24 described hereinabove. The exit of connector 60 from each coil spring is held and that the torsion forces employed in opening and closing the switch are not discipated by one or the other of coil springs 50 rotating relative to the pin 44 on which it is mounted in the housing cavity 18.

The configuration of the switch as illustrated on the drawings is a switch that is normally open. That is, in the unoperated condition of the switch with the plunger 14 and key top 12 in the uppermost position as shown in solid lines in FIG. 3, the laterally extending coil spring ends 52 and their contacts 54 are out of engagement. This condition is best illustrated in the sectional view of FIG. 5. In this normally open switch condition, the unoperated status of the switch is as shown in FIG. 3. The torsional forces of the coil springs 50 are, as shown in FIG. 5, overcome by inclined cams 62 formed on the opposite walls of the interior of cavity 18 of housing 32. The inclined cams 62 provide an expanding space therebetween as they approach the bottom of the cavity 18 in housing 32. In the condition shown in FIG. 5 and shown in solid lines in FIG. 3, the laterally extending coil spring ends 52 and their contacts 54 are held apart against the torsional forces of coil springs 50 by the location of the cams 62 and relation of the upper ends of the coil springs 50 relative to the upper end of cavity 18.

As the switch actuating plunger 14 is pressed downwardly by key top 12, the stem 40 of the plunger presses both of the spring ends 52 downwardly while the main body portion of plunger 14 compresses the coil springs 50. Incident this depression of plunger 14, the spring ends 52 move downwardly to the point where the inner surfaces of cams 62 are spaced such that the torsional forces of springs 50 propel the two ends 52 with their contacts 54 into electrical contact with one another. This relationship is shown in the sectional view of FIG. 6 and is depicted in the phantom showing on FIG. 3 along the section line 6—6. When force depressing the plunger 14 is released the plunger rises under the compressive forces of springs 50. At the same time, the ends 52 reengage the inclined surfaces of cams 62 on the inner walls of cavity 18 such that as the switch returns to its fully unoperated position the ends 52 of the springs 50 and their contacts 54 are again returned to the disengaged or open switch condition as shown in FIG. 5.

The upper movement of plunger 14 is limited by engagement of catches 42 on stem 40 with the underside edges of detents 38 disposed on the opposite walls of the interior of cavity 18 in housing 32.

It may be mentioned that the interior walls of the cavity 18 can advantageously be vertically grooved at 64 leading down to the flared bores 48. This, together with the groove 46 in the pin 44, facilitates assembly of the tiny coil springs 50 for the connector 60 of the coil spring to be guided down into the flared bore 48 to pass through the boss 22 in assembly of the switch parts.

One advantageous feature of the switch construction is the ability to use coil springs 50 which are identical in their wound configuration. In other words, a single supply of appropriately wound springs may be employed in assembly operations without having to select springs of different configurations. Thus, the location of the flared bores 48 in the bottom wall of cavity 18 disposes the two identically configured springs 50 in their proper relationship for the torsion forces of the springs to be available in bringing the ends 52 and their contacts 54 together when the plunger 14 is depressed and the downwardly inclined relationship of cams 62 permits the two spring ends 52 to move together. In moving together the inner downwardly bent ends forming contacts 54 cross like swords within the central portion of the cavity 18 as shown in FIG. 3.

It may be noted as shown in phantom on FIG. 3, that the guides 36 on plunger 14 serve by their engagement with the bottom wall of the cavity 18 in housing 32 to limit and stop downward movement of the plunger 14 against the pressure applied to key top 12 carried by the plunger. In this downward switch operated condition the ends 52 of coil springs 50 have moved their contacts 54 into circuit closing condition. This closing occurs approximately halfway through the downward depression of the switch plunger, giving the switch an advantageous operator feel and touch wherein over travel is permitted and the switch closes before the switch bottoms out. Downward movement of the plunger 14 is stopped when the lower ends of guides 36 on plunger 14 engage the bottom wall of the cavity 18 in housing 32.

It will be recognized that many variations can be made in the incline and relation of the cams 62 which, in the illustrated embodiment, as the plunger 14 is depressed permit the two spring ends 52 and their contacts 54 to move together. For example, on one wall of the cavity 18 a simple straight non-inclined guide cam may be provided whereas on the opposite wall the ramp inclined cam will act to engage one of the spring ends and control its movement relative to the other coil spring end to effect switch opening and closing. Also, the cams may have portions that are straight or non-inclined to the cavity 18 inner wall and then steeply inclined and then straight again such that rapid closing of the switch on the steep incline may be achieved if that be the desired operation for the switch. An important feature of the switch operation and one felt to contribute to long life of the switch contacts is that once the coil spring ends 52 move their contacts 54 into engagement with each other, continued movement under pressure of plunger 14 in compressing springs 50 does not result in relative movement between the point contact occurring by contacts 54 coming into engagement.

It should be appreciated from the above set forth disclosure of the invention that the switch and a keyboard embodying a multiplicity of such switches solve a number of problems mentioned as inherent in prior art devices. This switch is extremely uncomplicated and operates in an efficient manner with a minimum of moving parts.

It is to be understood that the construction, from an embodiment of the invention herein shown and described are to be taken only as a preferred representation of the invention. Various changes and modifications in the arrangement of the components, parts, units, elements, etc., may be resorted to without departing from the disclosure of the invention or the scope of the appended claims.

I claim:

1. A switch comprising:

a housing having a cavity therein opening outwardly of said housing;

a switch actuating plunger reciprocably mounted within said housing cavity;

coil spring means disposed within said housing cavity urging said plunger outwardly of said cavity, said coil spring means having connector means for connecting said switch into an electrical circuit to be controlled and a laterally extending end providing a first contact;

a second contact disposed in said cavity with torsional forces of said coil spring means urging said first contact relative to said second contact; and stationary cam means carried by said housing urging said laterally extending end relative to said second contact to open and close said contacts incident actuation of said switch between operated and unoperated conditions.

2. A switch as recited in claim 1 wherein said coil spring means includes a pair of coil springs in said housing cavity urging said plunger outwardly of said cavity, each coil spring has a connector for connecting said switch into an electrical circuit to be controlled and a laterally extending end providing a contact, said coil spring ends providing said first and second contacts.

3. A switch as recited in claim 2 wherein said stationary cam means is provided by inwardly facings cams on the inner opposite walls of said cavity with one cam engaging each coil spring end.

4. A switch as recited in any of claims 2 or 3 wherein the laterally extending ends of the coil springs are angled relative to the axes of the coil springs to cross in contacting each other in the switch closing condition.

5. A switch as recited in claim 1, 2 or 3 wherein detent means on the interior of said cavity engages with catch means on said plunger to retain said plunger within said cavity against the biasing force of said coil spring means.

6. A switch as recited in any of claims 1, 2 or 3 wherein said connector means on said coil spring means holds the coil spring means for application of the torsional forces in urging said contacts relative to each other.

7. A switch as recited in any of claims 1, 2 or 3 said laterally extending end of said coil spring means is angled relative to the axis of said coil spring means.

8. A switch as recited in claim 1 wherein said housing cavity is generally rectangular in cross section with a bottom wall having spaced bores to receive the connector means of said coil spring means, said bottom wall having a pin above each of said bores to retain said coil spring means within said housing cavity.

9. A switch as recited in claim 8 wherein upwardly extending parallel cams on the opposite walls of said cavity act in reciprocation of said plunger to move the laterally extending end of said coil spring means between operated and unoperated switch conditions.

10. A switch as recited in any of claims 1, 2, 3, 8 or 9 wherein inwardly extending ribs on the opposite sides of said cavity cooperate with guides on said plunger to guide reciprocating movement of said plunger within said cavity.

11. A switch as recited in any of claims 1, 2, 3, 8 or 9 wherein said connector means is formed by one end of said coil spring means and said laterally extending first contact end is at the opposite end of said coil spring means.

12. A switch as recited in claim 11 wherein said laterally extending end providing said first contact is angled relative to the axis of said coil spring means.

13. A switch as recited in claim 11 wherein said connector means extends generally axially of the coil spring means and passes through a bore in a bottom wall of said housing cavity for suitable connection into an electrical circuit.

14. A switch as recited in claim 13 wherein said bottom wall of said cavity has an outwardly projecting boss extending beyond said bore to engage within a suitable recess in a printed circuit board to facilitate mounting of said switch.

15. A switch as recited in claim 13 wherein said bore is flared into the housing cavity to facilitate inserting said connector means through said cavity into said bore in assembling said switch.

16. A switch as recited in any of claims 1, 2, 3, 8 or 9 wherein said actuating plunger includes a key top displaying indicia indicating the electrical circuit controlled by actuation of the switch.

17. A switch as recited in any of claims 1, 2, 3, 8 or 9 wherein at least said laterally extending end of said coil spring means is cylindrical in cross section.

18. A multiple assembly of switches as recited in any of claims 1, 2, 3, 8 or 9 wherein a switch assembly body provides a series of aligned generally rectangular cross section cavities, each cavity retaining a separate switch therein.

19. A multiple assembly of switches as recited in claim 18 wherein said assembly body includes a plurality of rows of a series of cavities to accommodate a multiple of switches.

* * * * *